United States Patent [19]

MacDonald

[11] 4,095,853

[45] Jun. 20, 1978

[54] DRAWER ROLLER GUIDE WITH PAIR OF ROLLERS MOUNTED ON BRACKET

[75] Inventor: Paul M. MacDonald, Scituate, Mass.

[73] Assignee: P. X. Industries, Inc., Rockland, Mass.

[21] Appl. No.: 747,805

[22] Filed: Dec. 6, 1976

[51] Int. Cl.[2] ..... F16C 29/04

[52] U.S. Cl. ..... 308/3.6; 308/202; 312/341 R

[58] Field of Search ..... 308/3.6, 3.8, 6 R, 203, 308/18, 202; 248/220.1; 16/91, 90; 211/151; 312/312, 341 R, 343, 344, 345, 348, 339, 339 X, 330, 333, 346

[56] References Cited

U.S. PATENT DOCUMENTS

| | | | |
|---|---|---|---|
| 2,202,209 | 5/1940 | Kennedy | 312/344 X |
| 2,255,290 | 9/1941 | Kennedy | 312/344 |
| 2,889,907 | 6/1959 | Sullivan | 211/151 X |
| 3,836,223 | 9/1974 | Signore | 312/341 R X |

*Primary Examiner*—Trygve M. Blix
*Assistant Examiner*—Douglas C. Butler
*Attorney, Agent, or Firm*—Morse, Altman, Oates & Bello

[57] ABSTRACT

A resilient roller guide assembly is provided for use with sliding drawers in cabinets, bureaus, chests and the like. The assembly includes an angle bracket having a pair of mutually perpendicular legs on each of which is mounted a roller rotatable about an axis parallel to the leg length and extending from one face of the leg. From the opposite face of the leg, at the inner edge thereof, is a lip adapted to seat against the edge of the opening in the cabinet through which the drawer moves. The rollers are of a diameter sufficient to engage and support the drawer at its bottom and along both sides when a unit is mounted at each lower corner of the drawer opening.

2 Claims, 4 Drawing Figures

DRAWER ROLLER GUIDE WITH PAIR OF ROLLERS MOUNTED ON BRACKET

BACKGROUND OF THE INVENTION

1. Field of the Invention

This invention relates generally to cabinet hardware and more particularly is directed towards a new and improved roller guide for use with drawers and the like.

2. Description of the Prior Art

Sliding drawers used in cabinets, bureaus, chests, and the like, are supported for sliding movement in a variety of different ways. The simplest and one of the oldest arrangements involves a rail upon which the drawer slides. While this approach is the least expensive, such systems inherently produce substantial friction, tend to bind and are not adapted to accommodate for minor misalignments or expansion and contraction of wood parts. More recent precision low-friction roller systems used in some guide systems include telescoping tracks and cooperating rollers between the tracks. Such systems, while providing low friction support, are relatively expensive to manufacture and assemble since they require precise alignment and fabrication of parts. Other systems have also been provided but are not entirely satisfactory from the standpoint of cost, simplicity and efficiency.

Accordingly, it is an object of the present invention to provide a simple, low cost drawer guide which is easy to install and provides smooth, low friction support for the drawer. Another object of this invention is to provide an inexpensive roller drawer guide which yieldably supports the drawer and is adapted to accommodate variations in dimensions of the drawer and the cabinet to which the drawer is mounted.

SUMMARY OF THE INVENTION

This invention features a roller guide for a drawer mounted in a cabinet, or the like, comprising a relatively flat bracket having a pair of right angularly disposed legs, a lip formed along the inner edge of each leg and at right angles to the plane of the bracket. A roller is rotatably mounted to the opposite side of each leg, each roller being mounted for rotation about an axis parallel to the length of its respective leg. The diameter of each roller and its location with respect to the bracket leg edge positions the periphery of the roller slightly beyond the leg edge to engage the side and bottom corners of a drawer. The assembly is relatively resilient to allow a limited amount of flexing of the rollers to take up any slack in the drawer or cabinet assembly.

DETAILED DESCRIPTION OF THE PREFERRED EMBODIMENT

Figure 1:
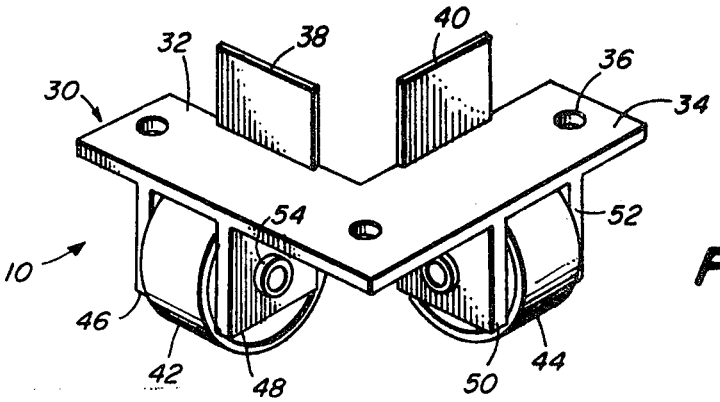
FIG. 1 is a view in perspective of a roller guide made according to the invention.

Referring now to the drawings, the reference character 10 generally indicates a drawer roller guide normally provided in pairs and mounted one at each lower corner of an opening 12 formed in a cabinet 14 in which is mounted a drawer 16. The cabinet 14 typically includes a front panel 18 in which the opening 12 is made rectangular and slightly larger than the drawer 16 to allow free movement of the drawer in and out of the cabinet. The cabinet may be provided with one or more drawers and may also include one or more doors, depending upon the particular use of the cabinet. The drawer 16 commonly is formed with front and rear walls 2o and 22, respectively, side walls 24 and 26 and a bottom wall 28. The drawer may be supported by various means, such as a drawer rail system of the sort shown in U.S. Pat. No. 3,980,365.

The drawer rail guide 10 is generally organized about an L-shaped bracket 30 having a pair of mutually perpendicular legs 32 and 34 which are substantially flat and coplanar and both being of substantially the same length. The legs are formed with holes 36 to receive screws or other fastening means for permanently mounting the guide to the lower corner of the opening 12 on the inner face thereof. While dimensions are not critical, typically, each leg may have an inside length of $1\frac{1}{2}$ inch and an outside length of $2\frac{1}{4}$ inch, for example. The bracket preferably is fabricated from a resilient plastic material, such as polyethylene, or the like, which is readily moldable, is inherently resilient, provides structural strength, and displays low friction characteristics.

Along the forward inner edge of each leg and extending perpendicularly from the plane of the bracket is a lip 38 for the leg 32, and a lip 40 for the leg 34. Each lip is relatively thin and may have a length of perhaps $\frac{1}{2}$ inch and a width of perhaps $\frac{3}{4}$ inch. The function of the lips 38 and 40 is to provide a positioning means for insuring that the guide is properly mounted to the front panel so that guide rollers 42 and 44 will be in the exact operating position to engage opposite lower corners of the drawer when the drawer is in place.

Extending from the rear face of each bracket leg 32 and 34 is a pair of spaced parallel roller supports 46 and 48 for the leg 32 and supports 50 and 52 for the leg 34. Each bearing support extends perpendicularly from the rear face of the bracket and perpendicularly to the plane thereof. These supports extend transversely of their respective legs and are spaced apart from one another to accommodate the rollers 42 and 44 supported therebetween. Each support has a width corresponding to the width of the leg and a length of perhaps $1\frac{3}{4}$ inch or so. Typically, the supports are perhaps $\frac{1}{2}$ inch apart, slightly in excess of the width of the rollers 42 and 44 and are formed integral with the bracket. Each support is formed with a circular opening 54 with the openings in each pair of supports being in coaxial alignment.

Figure 2:
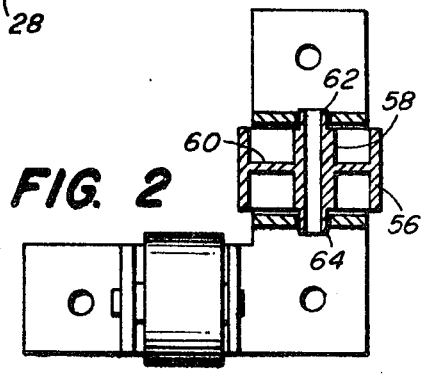
FIG. 2 is a view in front elevation thereof with one roller broken away to show the details of construction.

Mounted between each pair of supports is the roller 42 for the supports 46 and 48 and the roller 44 between the supports 50 and 52. Both rollers are identical and each preferably is molded in one piece construction from the same material as the bracket. Each roller includes a cylindrical outer rotor 56 and a central tubular hub 58 joined by means of an annular medial flange 60. The hub 58 is formed with reduced end portions 62 and 64 which are seated rotatably within the support openings 54, as best shown in FIG. 2.

Figure 3:
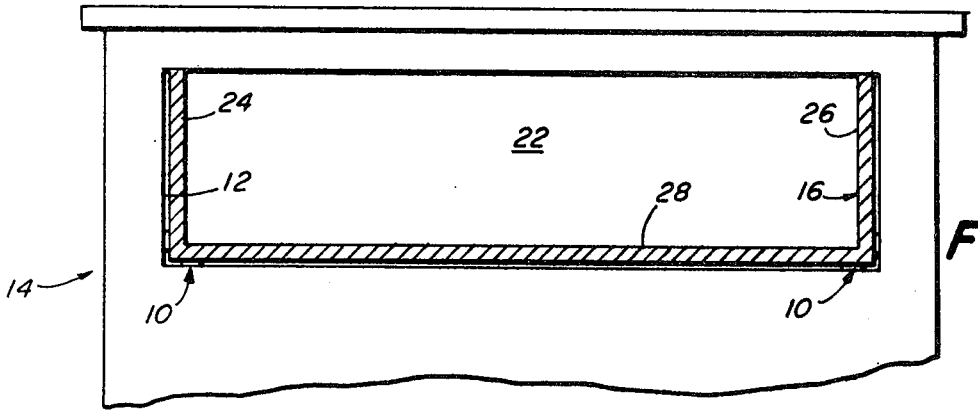
FIG. 3 is a view in front elevation showing roller guides made according to the invention installed in a typical drawer and cabinet unit, and, FIG. 4 is a detailed view in side elevation, partly in section, of a roller guide installed in operating position.
Figure 4:
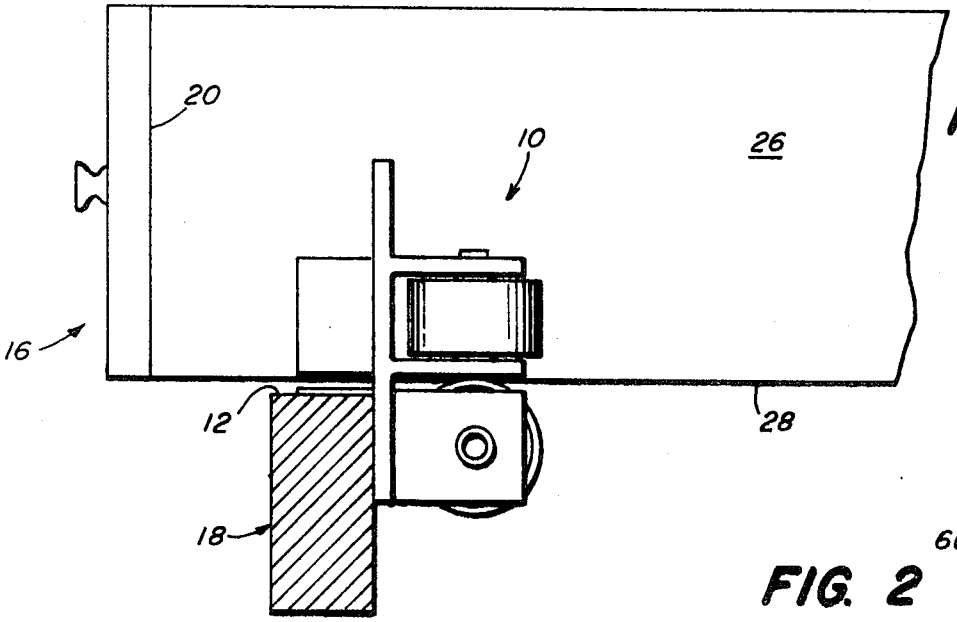

The diameter of the rollers is greater than the width of the supports and the rollers are so positioned with respect to the inner edges of the bracket legs and the lips 38 and 40 that the peripheral portions of the rotors 56 will extend inwardly of the edge of a cabinet opening, as best shown in FIGS. 3 and 4. In this fashion, the rollers engage the lower corners of the drawer, supporting the drawer both at the bottom and the sides and allowing the drawer to move freely and easily in and out without vertical or transverse motion. The bracket and its components are sufficiently resilient so that any dimensional changes incurred by expansion or contraction of the drawer or the cabinet will be accommodated without binding the assembly or interfering with the operation of the drawer.

The guide is easily installed without the use of gauges or pre-marking insofar as the lips 38 and 40 insure that the part will be placed automatically in its proper position.

Having thus described the invention, what I claim and desire to obtain by Letters Patent of United States is:

1. A roller guide for use in the corners of a cabinet opening for a drawer, comprising (a) a bracket formed with a pair of coplanar, integral, flat right angular legs of substantially equal length, said legs being formed with spaced openings to receive fasteners therethrough, (b) an imperforate, thin lip extending from the inner edge of each leg perpendicularly to one face of said bracket and to each other and adapted to seat against the corner edges of said cabinet opening to position said guide with respect to said drawer, and, (c) a roller mounted to the opposite face of each of said legs for rotation about an axis parallel to the length of said legs, the periphery of each of said rollers extending beyond the plane of its respective lip to engage said drawer, (d) a pair of spaced parallel supports extending perpendicularly from said opposite face of each leg at the mid portion thereof and integral with said bracket, said supports disposed transversely to the length of each leg, each pair of supports rotatably supporting one of said rollers, (e) each of said rollers including a central hub, a cylindrical outer rotor and an annular medial flange connecting said hub and rotor.

2. A roller guide, according to claim 1, wherein said guide is formed of a relatively stiff and resilient material.

* * * * *